United States Patent [19]

Baus

[11] 4,258,443

[45] Mar. 31, 1981

[54] SHIELDING FOR DAMP ROOMS

[75] Inventor: Heinz G. Baus, Thun, Switzerland

[73] Assignee: Showerlux Canada Ltd., Scarborough, Canada

[21] Appl. No.: 885,565

[22] Filed: Mar. 13, 1978

[30] Foreign Application Priority Data

Mar. 18, 1977 [DE] Fed. Rep. of Germany ..... 2711826
Sep. 8, 1977 [DE] Fed. Rep. of Germany ..... 2740374

[51] Int. Cl.[3] ..... A47K 3/14

[52] U.S. Cl. ..... 4/557; 4/607; 4/610; 16/90; 16/93 R; 16/96 R; 49/411

[58] Field of Search ..... 16/87 R, 87 B, 90, 91, 16/93 R, 94 R, 96 R; 49/405, 407, 408, 409, 410, 411, 413, 504, 414; 160/44; 4/149, 150, 154, 153; 267/73, 74; 403/229

[56] References Cited

U.S. PATENT DOCUMENTS

| | | | |
|---|---|---|---|
| 2,813,312 | 11/1957 | Loue et al. | 16/93 R X |
| 3,052,930 | 9/1962 | Mathews | 16/93 R X |
| 3,281,993 | 11/1966 | Riegelman | 49/425 |
| 3,384,998 | 5/1968 | Abramson | 16/90 X |
| 3,942,197 | 3/1976 | Sudmann et al. | 4/149 |
| 4,014,070 | 3/1977 | Rifkin | 16/6 R X |
| 4,073,035 | 2/1978 | Baus | 16/96 R |

FOREIGN PATENT DOCUMENTS

| | | | |
|---|---|---|---|
| 2634744 | 12/1977 | Fed. Rep. of Germany | 49/411 |
| 617407 | 2/1949 | United Kingdom | 403/229 |

OTHER PUBLICATIONS

"Sliding Steel Sash", *The Architectural Forum,* p. 210, Mar. 1939.

*Primary Examiner*—C. J. Husar
*Assistant Examiner*—Moshe I. Cohen
*Attorney, Agent, or Firm*—Herbert L. Lerner

[57] ABSTRACT

Enclosure for wet chamber, particularly for bathrooms or shower rooms with several adjacent slideable partitions with each partition suspended in an upper guide rail and with a lower guide member consisting of an elongated, box-shaped adapter seated on the edge of a wet-chamber tub, an elongated lower guide detachably fastened to the adapter. The guide rail has at least one guide with an inverted U-shape cross section with the outer leg as the longitudinal wall along the dry side of the room and with an inner free leg wall. A lower guide strip extends from the partition, first downwardly, then under the free leg wall, then upwardly to form a pocket open at the top into which the free U leg wall extends.

5 Claims, 5 Drawing Figures

SHIELDING FOR DAMP ROOMS

CROSS-REFERENCE TO RELATED APPLICATION

My allowed application, Ser. No. 677,797, filed Apr. 16, 1976, now U.S. Pat. No. 4,073,035.

BACKGROUND OF THE INVENTION

1. Field of the Invention

This invention relates to an enclosure for wet chambers and more particularly refers to a new and improved enclosure having several slideable partitions suspended in an upper guide rail, an adapter seated on the edge of a wet-chamber tub, and a lower guide integrated with the adapter.

2. Description of the Prior Art

In one known enclosure of this type for wet chambers, the lower guide member is made of two parts for reasons of hygiene, i.e., it consists of a compensation member and a guide rail which can be slipped onto the compensation member (German Published Prosecuted Application No. 25 16 851). The surface of the compensation member and/or the bottom surface of the guide member are slightly inclined, so that spray water that may have found its way into the U-shaped guides, open toward the top, can flow off toward the damp room side via discharge openings in the guide member. For cleaning, the guide rail is removed from the compensation member and is rinsed off. A snap-in fastening arrangement is provided to facilitate this job. Solid dirt particles and bacteria, however, can settle relatively quickly in the U-shaped guides.

SUMMARY OF THE INVENTION

It is an object of the invention to provide an enclosure for wet chambers with a detachable guide rail, having a lower guide which is basically less dirt-prone, and permits ready disassembly, cleaning or repair and installation.

With the foregoing and other objects in view, there is provided in accordance with the invention an enclosure for wet chambers, particularly for bathrooms/or shower rooms with adjacent slideable partitions which are movably suspended side by side from an upper guide rail, and having a lower guide member including an elongated, box-shaped adapter seatable on the edge of a wet-chamber tub, and an elongated guide rail integrated with the elongated box-shaped adapter of the lower guide member, the guide rail having at least one guide which has an inverted approximately U-shaped cross section transversely to the longitudinal axis of the adapter with the opening of the U facing the top surface of the adapter and with an outer leg wall of the inverted U constituting an outer longitudinal wall along the dry side of the room and another leg wall of the inverted U constituting an inner free leg wall with the opening of the inverted U having a width which is larger than the thickness of a lower guide strip extending from the first adjacent slideable partition, the lower guide strip extending from the partition, first downwardly, then under the free U leg wall, then upwardly to form a pocket open at the top into which the free U leg wall extends.

Other features which are considered as characteristic for the invention are set forth in the appended claims.

Although the invention is illustrated and described herein as embodied in shielding for damp rooms, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DETAILED DESCRIPTION OF THE INVENTION

Figure 1:
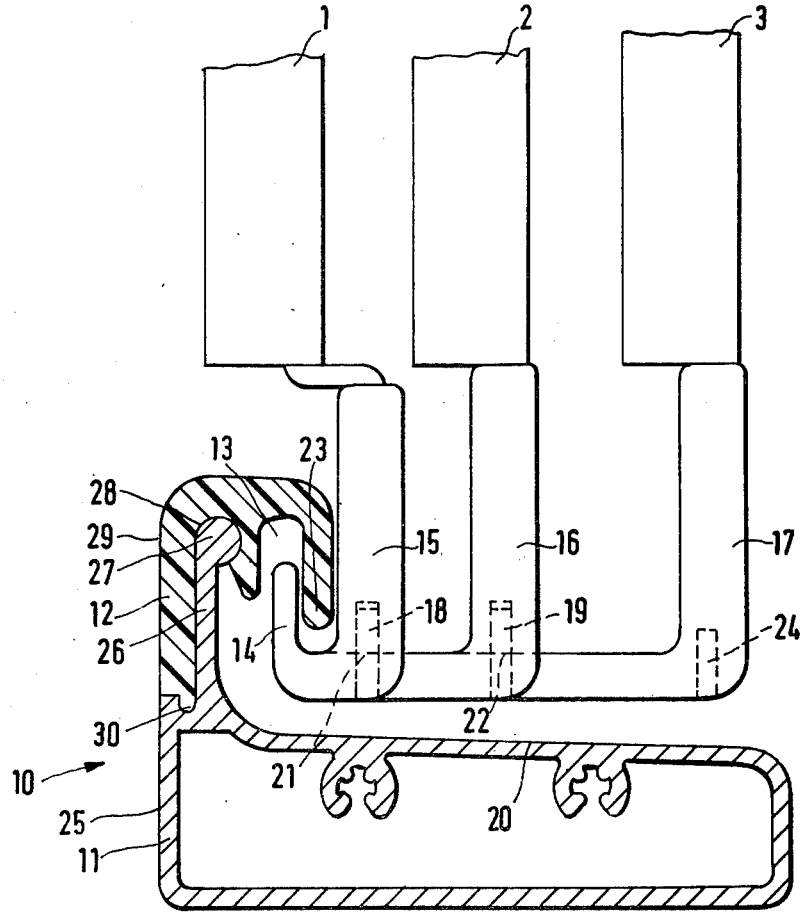
FIG. 1 is a sectional view of a lower guide member showing a first embodiment of the enclosure with partitions guided by means of their lower guide strips and a detachable guide rail.

In accordance with the invention, a first, approximately U-shaped guide is open at the bottom toward the top surface of the compensation member and is located in the region of the outer longitudinal wall facing the dry side of the room, of the guide rail. The lower guide strip of a first one of the partitions has a cross section which is open toward the top, i.e. U-shaped. The lower guide strip fits or engages the free U-leg wall of the first inverted U-shaped guide by passing behind and below the free U-leg wall. The other guides are likewise open at the bottom. In this manner, the guides in the guide rail are advantageously shielded against spray water. They do not form collectors, in which solid particles can accumulate.

A curtain for bath and/or shower rooms which can be pushed together in accordion-fashion and which carries as stiffening elements, guide rolls which engage in U-shaped guides, open toward the bottom, of a lower guide member integral with the edge of the tub is disclosed in U.S. Pat. No. 3,500,481. The known U-shaped guides are arranged in steps one below the other, with an overall inclination toward the tub side. Contrary thereto, the present invention provides, for one, a compensation member for adapting the enclosure to already installed bath or shower tubs, and in addition, a guide rail that can be detached from this compensation member, and/or releasable lower guide strips which will be described in detail in the following. Finally, the lower roll guidance can be dispensed with and, with an appropriate choice of the material for the guide rails and the lower guide strip and, with the indicated adaptation of the profile of the lower guide strip to the guide wall of the lower guide member, a simple sliding guide can be obtained.

In one embodiment of the invention the lower guide strip of each partition has a guide groove which is open toward the top surface of the compensation member or adapter. The opening width of the guide groove is matched to the thickness of an upward-pointing extension of the lower guide strip of the adjacently installed partition. In this embodiment, only the partition which, in the installed condition of the partition, is closest to the dry space among the parallel partitions, is consequently held with its lower guide strip in a U-guide of the detachable guide rail, while the adjacent partition, which hangs closer to the damp room, is held by the upward-pointing extension of its lower guide strip in the guide groove of the first-named partition. This system can be supplemented, of course, by further partitions which are arranged toward the damp room side and can be moved parallel to the others and are held together at the bottom. As is shown in the German Published Prosecuted Application 25 16 851, the lower guide member is provided on its upper side, in the vicinity of its outer longitudinal wall intended for the dry room side, with a rib for fastening the guide rail. According to the invention, this rib has a thickened outer end and the guide rail has a snap-in recess corresponding to this end. The axis of its outer longitudinal wall is parallel to the longitudinal wall of the adapter. The guide rail is held at this wall, for instance, by means of a tongue-and-groove joint, and is flush with the adapter on the outside, so that the lower guide member has no interfering, projecting parts on its outer longitudinal side.

In a modification or subvariant of the first embodiment, two partitions are held, one behind the other in the guide direction, in the U-guide behind the longitudinal wall facing the dry space, while a third partition has an extension of its lower guide strip with a guide groove open toward the top. An additional guide strip extends from above from the second partition in a direction facing away from the extension engaging the first-mentioned U-guide, and engages the guide groove of the third partition. In the closed position, the third partition shields, in this embodiment, the area between the first two partitions, while normally, in the first embodiment and the other embodiments, the third partition is situated in the closed position on an outer side, and the second partition shields the middle area.

In a second embodiment of the invention, the guide rail has, spatially adjacent to the first U-guide and at the same height as the latter, a second U-guide open at the bottom and, offset in stair-fashion from both, at least one further (third) U-guide. The lower guide strip of a second partition reaches under the guide strip of the first partition and engages with its extension behind the free U-leg wall of the second U-guide. The guide strip has a cross section open at the top, which is fitted to the second U-guide. The lower guide strip of a third partition, which is intended for cooperation with the third U-guide located lower than the first U-guide, is of a form corresponding to that of the first guide strip. This second embodiment has the advantage over the first embodiment in that each partition is held by itself in a U-guide and corresponding tolerances do not cumulate, so that the enclosure overall is more stable against shifts transversely to the panel plane and therefore, also minimizes chatter.

In both of the above-described embodiments of the invention, it is of course advantageous to make the top surface of the adapter or compensation member or the bottom surface of the guide rail, respectively, slightly inclined toward the damp room side.

In a third embodiment of the invention with a detachable guide rail, the starting point is a steep inclination in the abovementioned direction of the compensation member. All U-guides open at the bottom are located one below the other in stair-fashion and the lower guide strips of the partitions are of identical design and correspond to the lower guide strip of the first partition held at the lower guide member in the first-described embodiment. In the third embodiment, a prismatic hollow box profile is preferably used as the compensation member, the cover surface of which, being opposite the right angle and dropping approximately at an angle of 45°, is overlaid by the snapped-on guide rail. This third embodiment is preferred over the ones previously described. It can be designed advantageously so that each lower guide strip is held in its corresponding partition, vertically movable against spring force, and can be detached from the position reaching behind the guide wall.

To replace an individual partition, the side posts of the enclosure need not be detached in such an embodiment. The lower guide strip of the partition is simply snapped out of engagement with the guide wall of the guide rail; it is then pulled by spring force into the lower part of the partition. It is clear that the partition can be tilted somewhat about its upper guide. While the partition is suspended, the lower part of the frame can be detached and the panel can be replaced. Likewise, the partition can also be detached in known manner from its upper guide strip (German Published Non-Prosecuted Application No. 26 04 376) or unhung if the upper guide is designed accordingly.

The lower guide strips can be unsnapped, of course, in all partitions, which makes the lower guide rail accessible. This avoids removing the lower guide member for cleaning. The guide rail and the compensation member can be formed as an integrated cross section which is more advantageous or cheaper for production.

In a preferred fourth embodiment, a prismatic hollow-box profile is therefore used as the adapter as in the third embodiment, but its inclined cover surface is stepped and exhibits the approximately U-shaped guides open at the bottom which are arranged one below the other in stair-fashion and are delineated by guide walls. Each guide consists of a junction between the guide strip and the guide wall by means of engaging curved surfaces. The guide wall may have a cylindrical bead and the guide strip a correspondingly formed recess. This embodiment means a simplified profile for the guide rail and is particularly advantageous if the compensation member and the guide rail are made of one piece. To avoid friction in the normal hanging position of the partitions, the surfaces are shaped to effect loose engagement between the U-guide and the guide strip.

The backward spring movement of the guide strips is advantageously limited in both embodiments having unlatchable guide strips by a stop, so that a narrow gap remains in the vertical direction between the surfaces.

The invention will now be explained in greater detail with reference to the embodiment examples shown in the drawings.

The upper guide rail, which is constructed in known manner, (German Pat. Nos. 2 325 032 or 2 314 444) is not shown. In this upper guide, for instance, three partitions 1 to 3 are in the installed condition suspended side by side. A lower guide member 10 consists of an elongated, box-like adapter or compensation member 11 which can be placed on the edge of the bath or shower tub, and a detachable guide rail 12 with a guide 13 (FIG. 1) which transversely to the longitudinal axis of the compensation body 11 is of U-shaped cross section and is open toward the bottom. An extension 14 of a lower guide strip 15 of the partition 1 engages from below into the opening. The partitions 2 and 3 have similar guide strips 16 and 17, but their corresponding extensions 18 and 19 engage with guide grooves 21, 22 of the second and third guide strip 15 and 16 which are open toward the top surface 20 of the compensation member 11. The first guide strip 15 and its extension 14 cooperate with little clearance with the free U-leg wall 23 of the first U-guide 13. The thickness of the free U-leg wall 23 and its distance from the top surface 20 or its extent downward, and the opening width and depth as well as the thickness of the first lower guide strip 14 in the area of their engagement are matched to each other. This is true, of course, also for the guide grooves 21 and 22 and the corresponding extensions 18 and 19. The third guide strip 17 can have a guide groove 24 for connecting an additional partition. The partitions 1, 2, 3 are thus guided in telescope fashion, with the axes displaced. The compensation member 11, on its upper side, in the area of its longitudinal wall 25 intended for the dry room side, has a rib 26, which has a bead 27 at its free end. The guide rail 12 has a snap-in recess 28 corresponding to bead 27. The guide rail 12 runs with its outer longitudinal wall 29 axis-parallel to the longitudinal wall 25 of the compensation member 11, and is held at the wall 25 by a tongue-and-groove connection 30. Wall 29 is flush with wall 25 on the outside.

Figure 2:
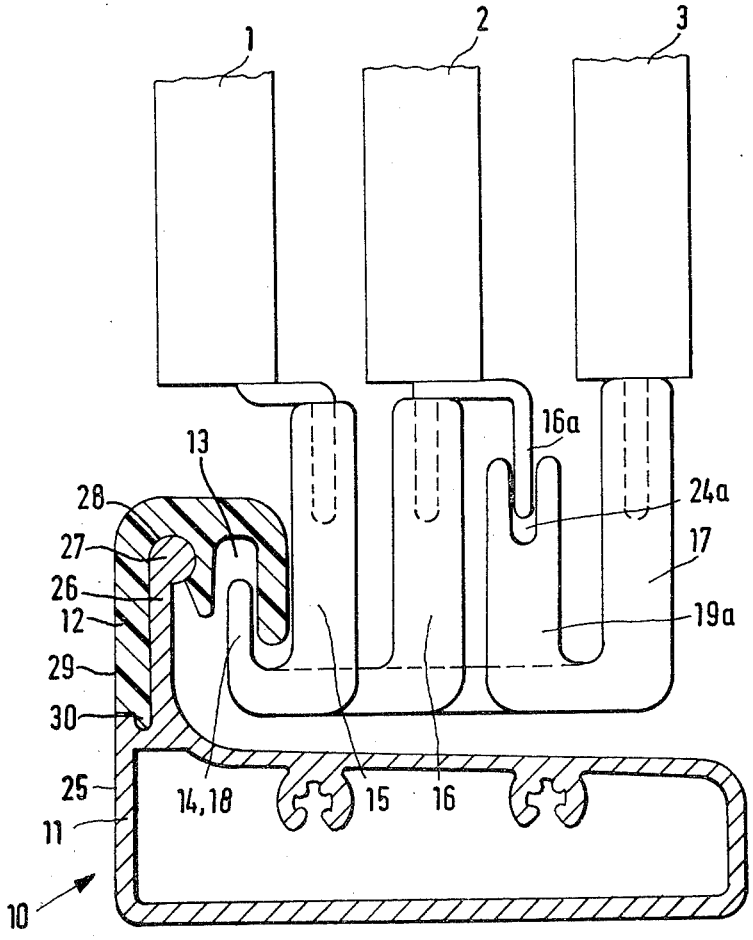
FIG. 2 is a subvariant of the first variant shown in FIG. 1.

The embodiment according to FIG. 2 differs from that of FIG. 1 in that two guide strips 15, 16 or their extensions 14, 18, respectively, disposed serially in guidance direction, engage in the first U-guide 13. The second partition 2 has an additional lower guide strip **16*a*, which engages from above in a guide groove 24*a*, open toward the top, and formed, in this case, in an upwardly bent extension 19*a* of the guide strip 17 of the third partition The other parts correspond to the embodiment as per FIG. 1. In order to extend the possible opening of this variant, which is limited to the width of one partition, provision can be made for the lower guide strips 15 and 16** to engage each other at least partially in telescope-fashion.

Similar parts are designated in the following figures with the same end numerals.

Figure 3:
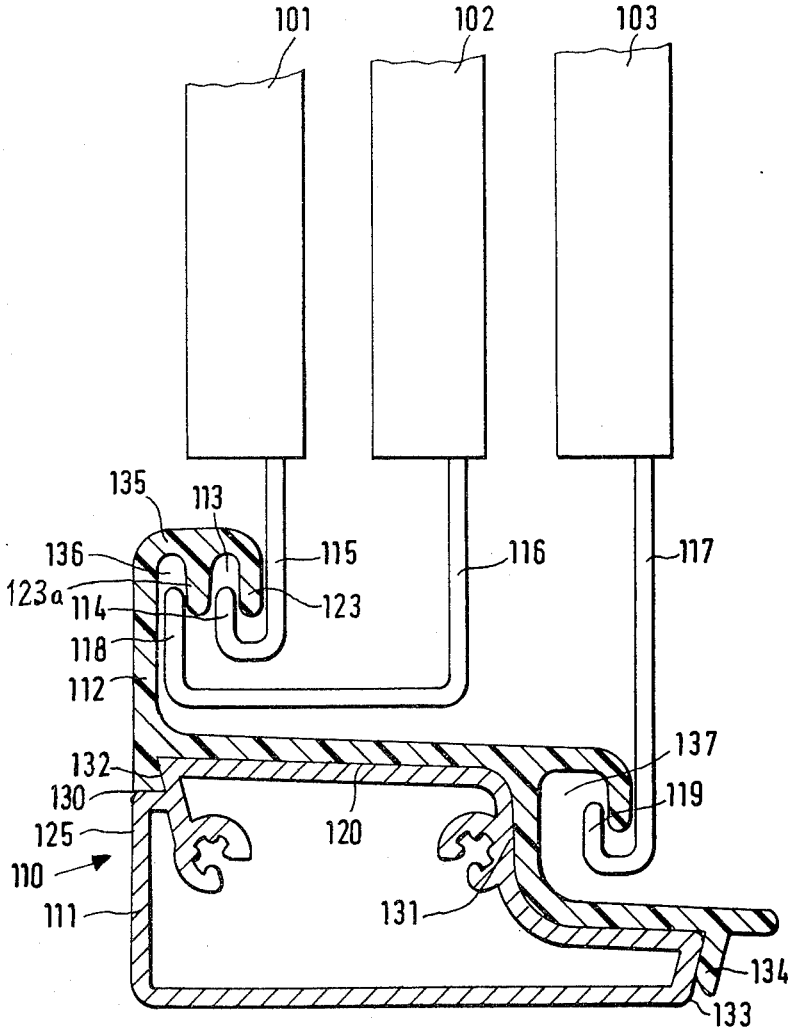
FIG. 3 is a second embodiment with a stepped lower guide member having a detachable guide rail.

In a second embodiment according to FIG. 3, the compensation member 111 and the guide rail 112 are stepped. The two common steps are designated by numeral 131. The guide rail 112 extends over the compensation member 111, and are secured by a tongue-and-groove connection 130 with an inclined surface 132 facing away from the top surface 120 of the compensation member 111 on the one side and an extension 134, which is in engagement with the inclined side surface 133 enclsoing an acute angle with the top surface 120, of the rail 112. The U-shaped guide 113 and the first lower guide strip 115 correspond in substance to the first embodiment. Next to the first U-shaped guide 113, there is, however, in an upper part 135 of the guide rail 112, at the same height as the first U-guide 113, a second U-guide 136 defined by a shank wall **123*a* serving as guide wall. An extension 118 of the second partition 102 traversing underneath the lower guide strip 115 of the first partition 101 engages U-guide 136 from below. A third U-shaped guide 137 is situated in the region of the step 131. This third guide 137 engages an extension 119 of the third partition 103, which corresponds to the extension 114 of the first partition 101. In this embodiment, the individual lower guide strips 115 to 117 must all be of different design; as can be seen, they have horizontally and vertically different dimensions, while the interleaved guide strips 15 to 17 of the first embodiment can be of identical design. However, the second embodiment is more stable against blows transversely to the plane of the panel of the partitions 102 and 103**.

In a third embodiment (FIG. 4), a prismatic hollow-box profile for the compensation member 211 is taken as the basis. The guide rail 212 overlays the inclined surface of the compensation member 211, which drops toward the damp room side, and has guides 213, 236 and 237, which are open toward the bottom and are defined by downwardly extending free guide or flank walls 223. The guide strips 215, 216 and 217 may have the same dimension from top to bottom. In that case, the partition 201, 202, 203 must be of different design. Preferably, however, also the partitions 201 to 203 can be of the same size and the lower guide strips 215 to 217 have a different dimension from the lower edge of the respective partition 201, 202 or 203 to their engagement part or their extension 214, 218 and 219. For the snap-on fastening of the rail 212, similar elements 230, 233 and 234 as in the second embodiment are provided.

The third embodiment has the advantage that the respective downwardly extending free flank wall 233 as guide wall of each U-shaped guide 213, 236 and 237 cooperates, in a close fit, with the corresponding profile, open at the top, of the lower guide strip 215, 216 or 217, respectively, so that in these areas self-cleaning takes place and dirt particles are flushed away via the inclined or curved portions of the rail bottom 240 underneath. In view of this, it is understood that the lower guide strips 15 to 17; and 115 to 117 of the first two embodiments can be perforated in their horizotal areas.

The guide strips 215 to 217 are preferably held vertically movably in the partitions 201 to 203 associated with them. For this purpose, each guide strip 215 to 217 has a sliding piece 241, to which one end of a spring 242 is fastened. The other end of spring 242 is connected to a clamping piece 244 which is held immovably in the lower part 243 of the partition 201, 202 and 203, respectively. Each guide strip 215 to 217 has an extension 245, which also may extend in the form of a strip over the lengthwise direction of the guide strip 201, 202, 203.

The operation of this arrangement is as follows:

To detach each partition 201 to 203 from its lower guide 215, 236, 237, the guide strip and the guide wall, e.g., 217 and 233, are unlatched from each other. To this end, one can push with a tool or by hand on the extension 245 and push the guide strip 217 by at least the distance s downward. The distance a of the lower side of the guide strip 217 from the surface of the guide rail 212 is, for course, somewhat larger than the distance s. By slightly swinging the partition 203 in FIG. 4 out to the right, the guide strip 217 is pulled up by the spring 242. The partition 203 is freely accessible, and so are the further partitions 202, 201 and the guide rail 212 by unlatching the guide strips 216, 215. It goes without saying that a compression spring can be used instead of the spring 242, which is stressed in tension upon unlatching. An extension of the guide strip, for instance, can be brought through a hole in the lower part of the guide wall and carry a top disc which rests on a compression spring (not shown).

The spring 242 is advantageously designed so that in the engagement position of the respective guide strips 215, 216, 217 and the guide wall 223, no force is exerted on the guide rail 212. Even so, the snap-on connection between the guide rail 212 and the compensation member 211 can be secured additionally for safety by a screw connection 246.

Figure 4:
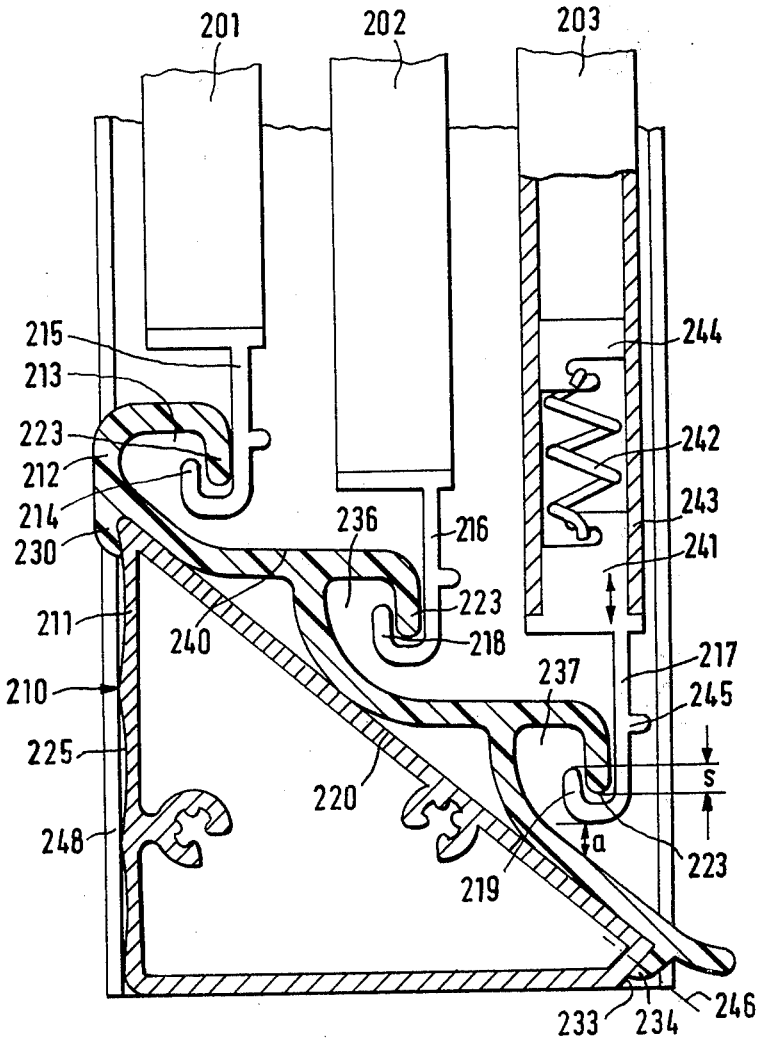
FIG. 4 is a third embodiment of the enclosure with a uniformly stepped lower guide member and a detachable guide rail.
Figure 5:
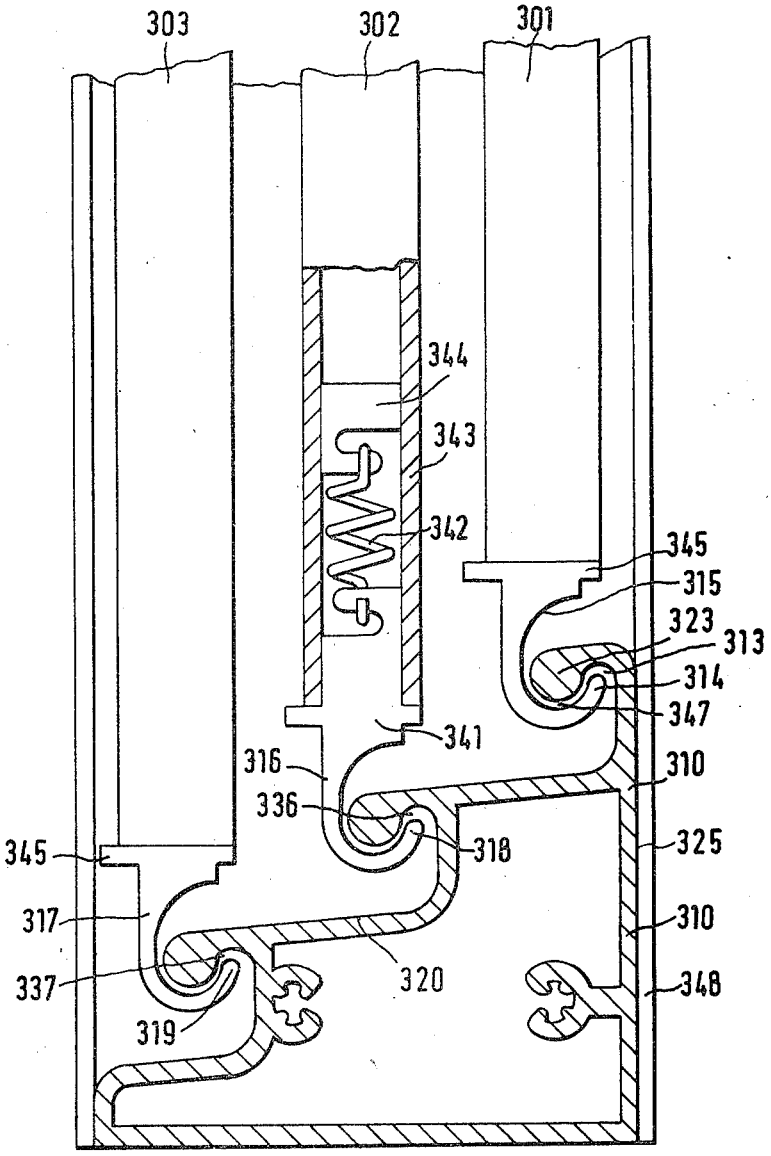
FIG. 5 is a fourth embodiment of the enclosure with a one-piece adapter and with guidance between a curved surface of the lower guide strip of each partition and a fitting curved surface of the corresponding guide wall of the lower guide.

In a fourth embodiment according to FIG. 5, the guide rail and the compensation member are of one piece, and form a guide member 310. The guide walls 323 are shaped substantially cylindrically and are engaged by the extensions 314, 318 and 319 of the guide strips 315 to 317. The latter have corresponding recesses 347. This connection is designed so that there is enough play in the engaged position. This can be adjusted, on the one hand, by the amount by which the upward-pointing extension 314, 318, 319 of each guide strip 315 to 317 is brought up. On the other hand, stops 345 are provided for limiting the backward movement of the spring at the lower guide strips 315 to 317. The mounting of the guide strip 315 to 317 in the lower part 343 of each partition 301 to 303 corresponds to that shown and described in connection with FIG. 4.

If oriented as per FIG. 5, the guide strip 315, for instance, is pushed down and somewhat to the left for unlatching it from its connection with the guide wall 323, whereupon it is pulled automatically upward by spring force, limited by the stop 345.

The compensation member 211 and the guide member 310, respectively, are set in both embodiment examples according to FIGS. 4 and 5 at both of their lengthwise ends in posts 248, 348 which are U-shaped in the horizontal cross section and establish the connection to the wall of the room or to another enclosure. The compensation members 11, 111, 211, 310 and the guide rails 12, 112, 212 can be formed of aluminum, and the guide rails 11, 111, 211, (310) can also be formed of synthetic material or coated with synthetic material so as to improve the coefficients of friction with the lower guide walls of the partitions 1, 2, 3.

There is claimed:

1. Enclosure for wet chambers, particularly for bathrooms or shower rooms, with adjacent slideable partitions which are movably suspended side by side from an upper guide rail, each of the partitions having a lower edge carrying a guide strip which is guided in respective guides on a guide member made up of an elongated box-shaped adapter seatable on the edge of a wet-chamber tub, and a guide rail selectively detachable from the adapter and having a surface descending toward the side of the wet chamber, comprising a stepwise disposition of the guides, the guides having guide walls downwardly extending from respective free edges thereof, each of the guide strips of the respective partitions having an upwardly open channel section with an upwardly directed free extension movable from below into a position of engagement behind a free edge of the respective guide walls, each of the guide strips being held in the respective partitions vertically displaceably therein against a tensile spring force and being releasable from the position of engagement thereof behind the free edge of the respective guide wall.

2. Enclosure according to claim 1 wherein said guide strips and said guide walls are formed with interengaging bent surface portions.

3. Enclosure according to claim 1 or 2 including a stop extending from the respective guide and limiting backward spring movement of the respective guide strip.

4. Enclosure according to claim 1 or 2 comprising at least one tension spring substantially vertically disposed in the interior of each of the partitions, said tension spring having an upper end fixed to the respective partition and a lower end secured to the respective guide strip so as to apply said tensile spring force thereto whereby said guide strip is at least partly withdrawable from the respective partition.

5. Enclosure according to claim 3 comprising at least one tension spring substantially vertically disposed in the interior of each of the partitions, said tension spring having an upper end fixed to the respective partition and a lower end secured to the respective guide strip so as to apply said tensile spring force thereto whereby said guide strip is at least partly withdrawable from the respective partition.

* * * * *